US006325145B1

(12) United States Patent
Swanson, Jr.

(10) Patent No.: US 6,325,145 B1
(45) Date of Patent: Dec. 4, 2001

(54) PRESSURE PULSE ATTENUATOR

(75) Inventor: Roy E. Swanson, Jr., Sugarland, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/595,590

(22) Filed: Jun. 15, 2000

(51) Int. Cl.[7] ..... E21B 31/00; E21B 21/08

(52) U.S. Cl. ..... 166/178; 166/163; 166/243; 175/320

(58) Field of Search ..... 166/162, 163, 166/178, 301, 242.1, 243; 175/320

(56) References Cited

U.S. PATENT DOCUMENTS 2,712,831 * 7/1955 Day ..... 138/26
3,370,544 * 2/1968 Thorpe, Sr. ..... 417/44.2
4,514,151 4/1985 Anders et al. ..... 417/540
4,936,383 * 6/1990 Towner et al. ..... 166/68
5,088,557 * 2/1992 Ricles et al. ..... 166/297

* cited by examiner

*Primary Examiner*—Thomas B. Will
*Assistant Examiner*—Jennifer H Gay
(74) *Attorney, Agent, or Firm*—Gerald W. Spinks

(57) ABSTRACT

A downhole in-line tubular accumulator for the attenuation of pressure pulses generated by operation of a downhole vibratory apparatus in an oil or gas well. An inner tube is positioned within a hollow housing, with the inner tube being attached to the housing at their upper ends. The lower end of the inner tube is unattached within the housing, thereby establishing an annular upper cavity between the inner tube and the housing, and an open lower cavity in the housing below the unattached lower end of the inner tube. The attenuator is run into the well on a work string. Pressure pulses traveling through the fluid column in the work string are attenuated by entrapped air in the annular upper cavity in the housing.

16 Claims, 1 Drawing Sheet

PRESSURE PULSE ATTENUATOR

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention is in the field of downhole equipment, often used in oil and gas well drilling and downhole equipment recovery, the operation of which is accompanied by repetitive pressure pulses in the drilling fluid, such as jarring devices. More specifically, it is a device that absorbs pressure pulses in the drilling fluid, generated by the rapid impacts which can be delivered by a tool such as a jarring tool, for the purpose of loosening a stuck object.

2. Background Art

In well operation, there is often a need for jarring, impact or vibration devices to move downhole stuck members. Jars are typically included in a pipe or work string to provide upward or downward impacts when activated. The impact is typically initiated when some type of valve or other triggering device in the tool triggers an action which applies stored energy in the form of an impact delivered to the stuck object.

This type of tool is usually supplied with a flow of drilling fluid delivered through the work string by a pump at the surface of a well site. The jarring tool often functions by momentarily interrupting the flow of drilling fluid, as these momentary interruptions of drilling fluid flow can be used to move valving members within the jarring tool. The frequent, repeated interruption of drilling fluid flow often results in the generation of pressure pulses in the drilling fluid, at the jarring tool. These pressure pulses travel back up the fluid column within the work string, to the surface at the well site.

At the surface, these pressure pulses are absorbed by equipment used in the delivery of drilling fluid downhole, such as the pump, standpipe, flex hose, swivel, and all the related fittings. In some such cases, the flex hose has been known to deflect sharply, and fittings have been known to fail. A pressure attenuating device on the pump would not likely adequately protect all the affected equipment.

It would be desirable, then, to have a means for attenuating these pressure pulses, to prevent damage to the well drilling or workover equipment. Further, it would be highly desirable to attenuate the pressure pulses at a downhole location close to the jarring tool, thereby protecting the majority of the work string from damage, as well as protecting the surface equipment.

BRIEF SUMMARY OF THE INVENTION

The present invention is an attenuator for use in reducing or eliminating back pressure pulses at a downhole location, preferably just above the pressure pulse generating device, such as a downhole jar. Terms such as "upper" and "lower", "above" and "below", are used herein to refer to the uphole and downhole directions, since the tools discussed herein may be used at a non-vertical well bore location. A hollow tubular housing has an upper sub for attachment to a work string, and a lower sub for attachment, either directly or indirectly, to a downhole pulse generating device. Preferably, the attenuator device is installed immediately above the pulse generating equipment. An inner tube is suspended within the hollow housing, by having its upper end threaded into the upper sub. The lower end of the inner tube is suspended within the hollow housing. As the work string is lowered into the well and fluid fills the work string, an air pocket at atmospheric pressure is trapped in the annular upper cavity between the inner tube and the hollow housing. The open lower cavity below the lower end of the inner tube fills with drilling fluid.

As pressure pulses travel back up the work string into the attenuator, they alternatingly compress and decompress the trapped air pocket, by driving fluid momentarily from the open lower cavity up into the annular upper cavity. The air pocket thusly absorbs the pressure pulses, or at least significantly reduces their magnitude. A longer inner tube can be used, with its lower end suspended near the lower end of the hollow housing, to more effectively absorb pressure pulses generated at a lower frequency. Conversely, a shorter inner tube can be used, with its lower end suspended near the longitudinal midpoint of the hollow housing or even higher, to more effectively absorb pressure pulses generated at a higher frequency. The most effective frequency response of the particular configuration is related to the relative lengths of the fluid column above the lower end of the inner tube and the trapped air pocket. Further, the effectiveness of the attenuator is enhanced by establishing the largest possible cross sectional area in the annular upper cavity.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
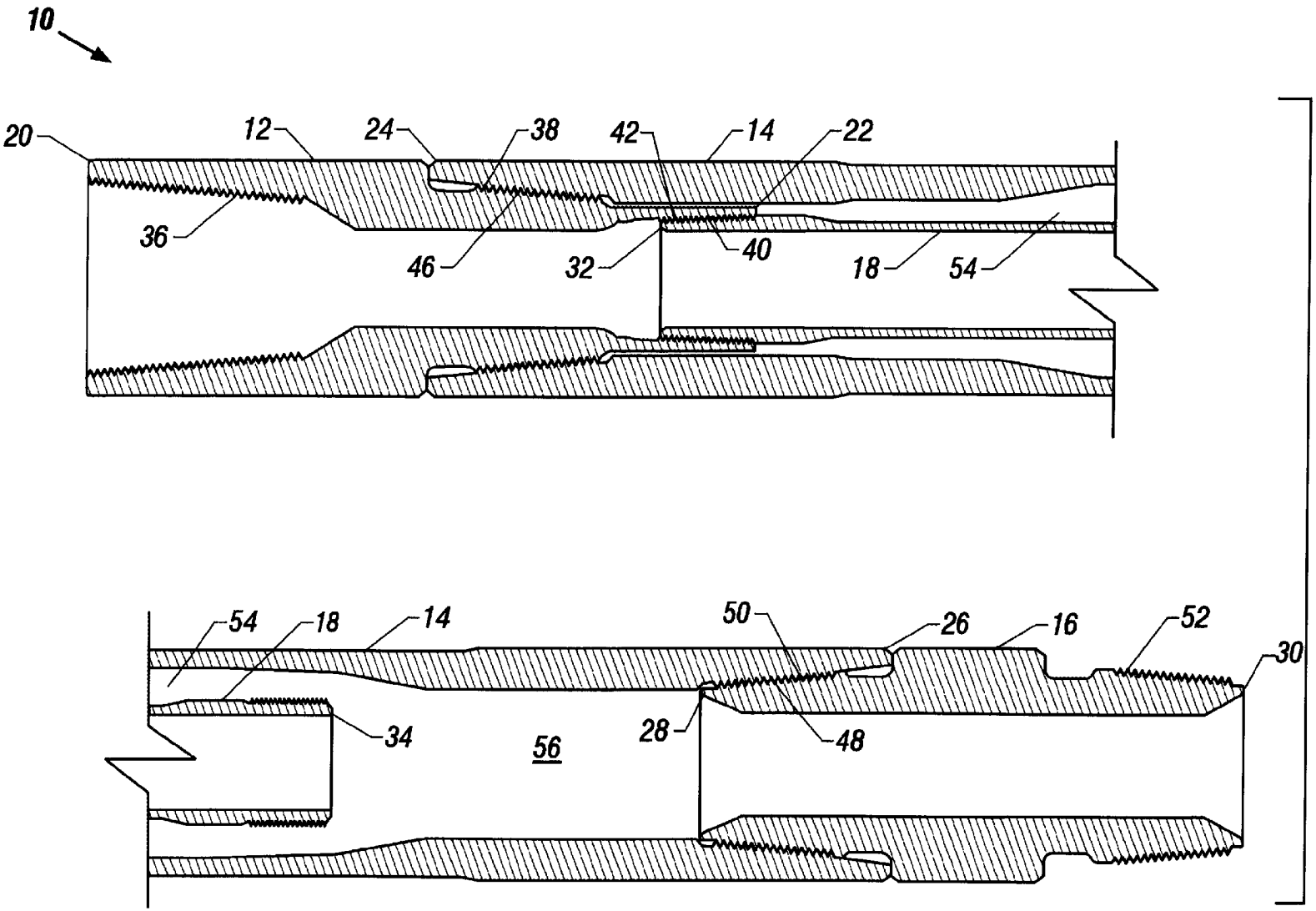
FIG. 1 is a longitudinal section view of a tool according to the present invention.

As shown in FIG. 1, the preferred embodiment of the pressure pulse attenuator 10 according to the present invention includes an upper sub 12, a hollow housing 14, a lower sub 16, and a hollow inner tube 18. The upper sub 12 has a tool entry port 20 at its upper end, where drilling fluid enters the tool 10 from the work string (not shown). The upper sub 12 also has a lower end 22 projecting down into the upper end 24 of the hollow housing 14. The lower sub 16 has an upper end 28 projecting up into the lower end 26 of the hollow housing 14. The lower sub 16 also has a tool exit port 30 at its lower end, where drilling fluid exits the tool 10 into the work string (not shown) or another item of downhole equipment (not shown).

The upper end 32 of the hollow inner tube 18 is threadedly attached to the lower end 22 of the upper sub 12, where male threads 42 of the inner tube 18 thread into female threads 40 of the upper sub 12. The lower end 34 of the inner tube 18 is not attached, being suspended freely within the hollow housing 14. Female threads 36 are provided at the upper end of the upper sub 12, to facilitate the attachment of the upper sub 12 to a work string (not shown). Male threads 38 at an intermediate location on the upper sub 12 thread into female threads 46 in the upper end 24 of the hollow housing 14. Male threads 50 on the upper end 28 of the lower sub 16 thread into female threads 48 in the lower end of the hollow housing 14. Male threads 52 on the lower end of the lower sub 16 are provided to facilitate the attachment of the lower sub 16 to a work string (not shown), jarring device (not shown), or other piece of downhole equipment (not shown).

Suspension of the inner tube 18 from its upper end 32 into the hollow housing 14, in a substantially coaxial relationship, creates an annular upper cavity 54 between the inner tube 18 and the hollow housing 14, above the lower end 34 of the inner tube. This annular upper cavity 54 is sealed at the top by sealing threads 40, 42 on the upper sub 12 and the inner tube 18. The annular upper cavity 54 is open at its lower end. Therefore, as the attenuator 10 is lowered into a well bore on a work string, the air within the annular upper cavity 54, at atmospheric pressure, is trapped therein. As pressure within the attenuator 10 increases, the trapped air pocket in the upper annular cavity 54 shrinks, allowing a lower portion of the upper annular cavity 54 to fill with drilling fluid. A lower, open cavity 56 exists within the hollow housing 14, below the lower end 34 of the inner tube 18. The lower cavity 56 is open to the annular upper cavity 54 at its upper end and open to the flow path through the lower sub 16 at its lower end. This lower cavity 56 fills with drilling fluid as the attenuator 10 is lowered into the well bore.

As drilling fluid is pumped through the attenuator 10, the operation of a pulse generating device (not shown), such as a jarring device, below the attenuator 10 creates back pressure pulses which propagate upwardly into the attenuator 10. As a pressure pulse enters the attenuator 10 at the exit port 30, it creates a pressure wave which propagates upwardly through the drilling fluid into the lower cavity 56 within the hollow housing 14, and into the fluid filled portion of the annular upper cavity 54. This pressure wave is absorbed or attenuated by a slight compression of the trapped air pocket in the upper portion of the upper annular cavity 54. As the pressure wave subsides, the trapped air pocket in the upper portion of the upper annular cavity 54 slightly expands.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

I claim:

1. A downhole pressure pulse attenuation device, comprising:

a hollow housing having an upper end adapted for fluid flow attachment to a work string, said hollow housing having a lower end adapted for fluid flow attachment to a downhole tool;

an inner fluid flow path within said hollow housing, from said upper end of said hollow housing to an internal port at a longitudinally intermediate location within said hollow housing;

an upper cavity within said hollow housing above said internal port, said upper cavity having a closed upper end and an open lower end; and a lower cavity within said hollow housing below said internal port, said lower cavity having an upper end open to said lower end of said upper cavity, and said lower cavity having a lower end in fluid flow communication with said lower end of said housing.

2. The device recited in claim 1, further comprising:

an upper sub attached to said upper end of said hollow housing to adapt said hollow housing for attachment to the work string;

an entry port at an upper end of said upper sub adapted for fluid flow attachment to the work string;

a lower sub attached to said lower end of said hollow housing to adapt said hollow housing for attachment to the downhole tool; and an exit port at a lower end of said lower sub adapted for fluid flow attachment to the downhole tool.

3. The device recited in claim 2, further comprising a hollow inner tube mounted within said hollow housing to define said inner fluid flow path from said upper sub to said internal port within said hollow housing.

4. The device recited in claim 3, wherein:

an upper end of said hollow inner tube is connected to said upper sub; and said internal port is located at a lower end of said hollow inner tube.

5. The device recited in claim 1, wherein said upper cavity is substantially longer than said lower cavity, to attenuate lower frequency pressure pulses.

6. The device recited in claim 1, wherein said upper cavity is approximately the same length as said lower cavity, to attenuate higher frequency pressure pulses.

7. A downhole pressure pulse attenuation device, comprising:

a hollow tubular housing;

an upper sub having a lower end attached to an upper end of said housing, said upper sub having an upper end adapted for fluid flow attachment to a work string;

a lower sub having an upper end attached to a lower end of said housing, said lower sub having a lower end adapted for fluid flow attachment to a downhole tool;

a hollow inner tube within said housing, said inner tube having an upper end attached to said upper sub in a fluid flow relationship, said inner tube having an open lower end within said housing;

an upper cavity within said housing above said open lower end of said inner tube, said upper cavity having a closed upper end and an open lower end; and a lower cavity within said housing below said lower end of said inner tube.

8. The device recited in claim 7, wherein said connection of said inner tube to said upper sub establishes a fluid seal adjacent said upper end of said upper cavity.

9. The device recited in claim 7, wherein:

said inner tube is positioned within said upper cavity; and said upper cavity comprises an annular upper cavity between said housing and said inner tube.

10. The device recited in claim 7, wherein said upper cavity is substantially longer than said lower cavity, to attenuate lower frequency pressure pulses.

11. The device recited in claim 7, wherein said upper cavity is approximately the same length as said lower cavity, to attenuate higher frequency pressure pulses.

12. A downhole pressure pulse attenuation device, comprising:

a hollow tubular housing;

an upper sub having a lower end attached to an upper end of said housing, said upper sub having an upper end adapted for fluid flow attachment to a work string;

a lower sub having an upper end attached to a lower end of said housing, said lower sub having a lower end adapted for fluid flow attachment to a downhole tool;

a hollow inner tube within said housing, said inner tube having an upper end attached to said upper sub in a fluid flow relationship, said inner tube having an open, unattached, lower end within said housing;

an annular upper cavity between said housing and said inner tube, said annular upper cavity having a closed upper end and an open lower end; and a lower cavity within said housing below said lower end of said inner tube.

13. The device recited in claim 12, wherein said hollow housing and said hollow inner tube are substantially coaxially positioned.

14. The device recited in claim 12, wherein said connection of said inner tube to said upper sub establishes a fluid seal adjacent said upper end of said annular upper cavity.

15. The device recited in claim 12, wherein said upper cavity is substantially longer than said lower cavity, to attenuate lower frequency pressure pulses.

16. The device recited in claim 12, wherein said upper cavity is approximately the same length as said lower cavity, to attenuate higher frequency pressure pulses.

* * * * *